United States Patent [19]

Kirshenbaum et al.

[11] 4,051,265

[45] Sept. 27, 1977

[54] PACKAGE FOR LIGHT AND OXYGEN SENSITIVE FOOD

[75] Inventors: Gerald S. Kirshenbaum, Fanwood; Elliot A. Vogelfanger, Edison, both of N.J.

[73] Assignee: Celanese Corporation, New York, N.Y.

[21] Appl. No.: 717,840

[22] Filed: Aug. 26, 1976

Related U.S. Application Data

[63] Continuation of Ser. No. 513,688, Oct. 10, 1974, abandoned.

[51] Int. Cl.[2] ..... B65B 25/00

[52] U.S. Cl. ..... 426/107; 206/497; 215/1 C; 215/12 R; 260/42.46; 426/124; 426/130

[58] Field of Search ..... 215/1 C, 12 R; 206/497; 426/107, 124, 130, 396, 398, 415; 260/42.46

[56] References Cited

U.S. PATENT DOCUMENTS

| | | | |
|---|---|---|---|
| 3,451,538 | 6/1969 | Trementozzi | 215/1 C X |
| 3,542,567 | 11/1970 | Finley et al. | 426/130 X |
| 3,547,294 | 12/1970 | Williams | 215/12 R |
| 3,681,092 | 8/1972 | Titchenal et al. | 426/412 |
| 3,784,661 | 1/1974 | Schaul et al. | 260/42.46 X |

FOREIGN PATENT DOCUMENTS

| | | | |
|---|---|---|---|
| 1,031,035 | 3/1963 | United Kingdom | 426/415 |

OTHER PUBLICATIONS

Modern Packaging Encyclopedia, 1968, issue vol. 41, No. 7A, July 1968.

*Primary Examiner*—Steven L. Weinstein
*Attorney, Agent, or Firm*—Marvin Bressler; Linn I. Grim; T. J. Morgan

[57] ABSTRACT

A container comprising a blow moldable thermoplastic frame defining a volume for the storage of a fluid. The thermoplastic frame is opaque barring the transmittance therethrough of light having a wavelength in the range of between about 3500 and 5500 Angstrom units. The container is further characterized by an overwrap of a thermoplastic film disposed about the thermoplastic frame. The overwrap film is characterized by its ability to bar the transmittal therethrough of oxygen. The container is especially suited for the storage, at or near ambient conditions, of liquid food subject to spoilage by the action of light waves, oxygen and odor permeation.

11 Claims, 3 Drawing Figures

PACKAGE FOR LIGHT AND OXYGEN SENSITIVE FOOD

This is a continuation of application Ser. No. 513,688, filed Oct. 10, 1974 now abandoned.

BACKGROUND OF THE DISCLOSURE

Field of the Invention

The instant invention is directed to a container for the storage, at or near ambient conditions, of liquid foods subject to spoilage due to the action of light waves, oxygen and other gaseous species. More specifically, the instant invention is directed to a container which permits the unlimited storage under ambient conditions of a liquid food which includes a thermoplastic body characterized by the nontransmittance of light waves having a deleterious effect on the liquid food and an overwrap film which bars the transmittability through the container of oxygen and other gaseous contaminants.

BACKGROUND OF THE PRIOR ART

The storage and packaging of foods has always been primarily considered as a marketing problem. That is, primary consideration is usually given to the attractiveness of the package to entice the customer. This philosophy has often been employed in the packaging and storaging of liquid foods, including probably the most important liquid food, milk. However, many liquid foods, including milk, are subject to deleterious effects if stored under improper conditions. It has been found, for instance, that the nutritional value and flavor of liquid foods, especially milk, are adversely affected by exposure to light, especially visible light having a wavelength in the range of between about 3500 and 5500 Angstrom units. In addition, it has been established that exposure to oxygen also oxidizes liquid foods, especially milk. Oxidized foods are manifested by depleted nutritional food values as well as unpalatable taste. As a correlary to the adverse effect of oxygen on liquid foods, it is also noted that other gases that permeate through the package to the liquid food often adversely affects flavor of the food. Specifically, odors from other foods have been known to cause an unpleasant flavor in liquid foods.

Many solutions have been proposed for solving the problems associated with storage of liquid foods, especially milk. Many of these solutions are directed to environmental changes in the conditions under which the liquid foods are stored. These solutions include using light sources that do not emit light waves which produce adverse effects on the liquid foods. Other solutions are directed to the manner in which the packages of liquid food, for instance, milk, are stored prior to sale. Such solutions are obviously of some benefit but they do not attack the fundamental problems associated with the storage of liquid foods. The fundamental solution of problems associated with storage of liquid foods which include in addition to milk other dairy products such as cream, fruit juices, especially citrus juices such as orange juice and the like lies in the employment of a container that overcomes all environmental conditions under which the liquid food is stored.

Probably, the most common container in the prior art for the storage of milks, fruit juices and other liquid foods has been clear glass. Glass has the advantage of being capable of holding the liquid over any length of time without being structurally changed. However, glass bottles or containers have several disadvantages which have significantly decreased their use as a container for milk and other liquid food products. Among these disadvantages is the brittleness of glass which, as everyone knows, results in extensive breakage. In addition, glass containers are very heavy. They are also very costly in monetary and energy requirement terms. Their cleaning, for reuse, causes significant pollution problems in that the detergents and soaps employed must be disposed of. Of even greater significance, glass is transparent to visible light. Since the light waves that degrade milk and other liquid food products are in the ultraviolet to visible range, that is, in the range of between about 3500 to 5500 Angstroms, glass provides no protection against the adverse effect of light on milk and other liquid food products.

It is noted that the problem of transparency in glass may be overcome by employing pigmented glass. This solution, of course, does not overcome the disadvantages inherent in the use of glass mentioned above. Also, from a marketing point of view, pigmented glass, i.e., amber glass, is unattractive especially when employed as a container for milk.

The above disadvantages of using a glass container for the packaging and storing of liquid food products have been recognized by those skilled in the packaging and container arts. Thus, a large percentage of this market has been taken over by paper, or more specifically, polyethylene coated paper containers. Paper containers overcome many of the disadvantages inherent in the use of glass. However, their use presents other problems as serious as those associated with glass containers. The most serious problem associated with the use of paper containers is wicking. Wicking is a characteristic property of paper products wherein liquids are drawn through the paper structure to decrease its structural integrity. This well known phenomenom of paper containers limits the shelf life of a liquid filled paper container. Of course, if the container is used in a very short time this problem is not serious. However, over long periods of time wicking ultimately destroys the structural integrity of any paper container in which a liquid is disposed. As will be discussed below, the growing use of liquid food products stored for long periods of time suggests the limitation of paper products as a container material.

Other problems associated with paper containers for use in packaging and storing of liquid food products is their difficulty in forming a structurally sound container. Oftentimes, poor forming results in leaks due to pinholes, poor sealing of the seams and the like. These structural defects, of course, cause contamination of the liquid food due to contact of the liquid food with the outside environment.

A third difficulty of employing a paper product as a container for liquid foods such as milk and other dairy liquid products is their non-resealability. As is well known in the art, milk containers provide a large opening which is almost impossible to reseal. Thus, these containers are not suitable for use in those cases where all of the liquid food is not to be consumed in a very short period of time.

The above disadvantages of glass and paper containers for the packaging and storing of milk, dairy, juice and other liquid food products has resulted in the development of an entirely new type of container for these applications which provides significant improvements in the packaging and storing of liquid foods. This type of container is made up of a thermoplastic polymeric material. Specifically, the material employed is a blow moldable thermoplastic. This type of a container produced by blow molding techniques, for milk and other liquid food products, has met with excellent acceptance in the field. There has been significant increases in market penetration of thermoplastic milk and other food containers which has occurred in the last few years. This trend is continuing in view of the significant advantages obtainable by the use of thermoplastic liquid food containers. Thermoplastic liquid food containers combine the advantages of glass, that is, excellent non-degradable structural integrity over prolonged periods of time, in combination with the advantages of paper containers, that is, non-breakability, and light-weight construction.

In spite of the advantages of employing thermoplastic rather than paper or glass containers there are three significant problems mentioned above which do apply to conventional thermoplastic liquid food containers. These problems are the adverse affect on the nutrient value, as well as the flavor of the liquid food, especially milk, resulting from the effects of light waves in the wavelength range of 3500 to 5500 Angstrom units. The other deficiency of thermoplastic containers is deleterious affect of oxygen permeation on the nutrient values and flavor of the liquid food. That both of these phenomenon cause the same adverse result is indicative of the theory that both phenomenon result in oxidation of the liquid food. The third problem not solved by employing a thermoplastic liquid food container is that of flavor contamination due to odors present in the environment in which the liquid food is stored. This problem is associated with the oxygen permeation problem in that both are basically problems of gas permeation.

Although the problems associated with the use of plastic containers are significant, they do not at present represent a barrier to the use of these containers. As those skilled in the dairy and similar food arts are aware, dairy products such as milk as well as other liquid food products such as fruit juices and the like are usually sold and consumed within a short period from the time they are placed in the container. The problems mentioned above are time related. The short period of time between packaging and usage of most liquid food products significantly decrease the significance of these adverse effects.

A recent development in liquid food technology, and especially in milk and other dairy products, is the development of super-pasteurized liquid foods. Pasteurization, as those skilled in the art are aware is a method employed to significantly decrease the concentration of bacteria or bacterial spores in a liquid food product. By maintaining pasteurized milk, dairy or other liquid food product at a sufficiently low temperature the food is retained in its fresh state and if consumed within a reasonable period of time no more stringent sterilization techniques are necessary. In addition, conventional sterilization techniques, other than pasteurization, often causes liquid food products, especially milk, to have an unpleasant taste or flavor. Thus, sterilized milk has not as yet been successfully marketed.

Recently, a new technique has been developed which essentially destroys all the bacteria in the liquid food product without significantly affecting the taste or flavor of the liquid food product. This technique offers significant improvements over pasteurized liquid food products. In addition to the obvious advantage of being essentially free of bacteria, super-pasteurized or, as they are sometimes called, aseptic liquid food products provide significant advantages over pasteurized liquid food products. Because they are essentially free of bacteria these foods may be stored at ambient conditions. The saving in energy costs for refrigeration is considerable at the food processing plant and more significantly at the food store. More significantly, because the aseptic liquid foods can be stored for long periods of time at or near room temperature the number of shipments from the processing plant, for example the dairy, to the retail establishment is significantly decreased.

The significant improvements inherent in the use of a super-pasteurized or aseptic liquid food product such as milk which is formed by exposure of the milk or other liquid food product to very high heat temperatures, i.e., 240° to 320° F. for very short periods of time, i.e., 2 to 10 seconds, necessitates a reconsideration of the container requirements for such a product. Obviously, glass containers are no more suitable for this application than they are for pasteurized milks and other liquid product applications. Their brittleness represent even more significant disadvantages in this application where long storage or shelf life is required. Paper containers which are subject to wicking are unsatisfactory in an application such as this where long shelf life or storage time is required. Thermoplastic containers, which are oftentimes constructed of polyethylene, as presently designed, are also unacceptable for long shelf life applications. The problems discussed above, oxidation due to light and oxygen permeation, which are time dependent, become overwhelming in these long term storage applications.

SUMMARY OF THE INVENTION

The instant invention is directed to a new container which is suitable for use in packaging and storage of liquid foods which may be stored under sub-ambient or ambient conditions for long periods of time. The container of the instant invention retains excellent structural integrity, although it is a relatively light weight structure, provides excellent sealability for retention of freshness and most important, overcomes the problems associated with the oxidation of liquid food products which are stored over long periods of time. That is, the container of the instant invention is suitable for exposure to visible light in the wavelength range of between about 3500 to 5500 Angstrom units. Moreover, the container of this invention is suitable for long term storage of liquid food products exposed to air, that is, to the atmosphere which of course is 21 percent, by volume, oxygen.

In accordance with the instant invention a container is provided which includes a blow moldable thermoplastic body defining a volume for the storage of a fluid. The body is provided with means for ingress and egress of the fluid and is characterized by its ability to essentially bar the transmittance therethrough of light having a wavelength in the range of between about 3500 and 5500 Angstroms units. The container is further characterized by an overwrap of a thermoplastic film disposed about the thermoplastic body. The thermoplastic film overwrap is characterized by its ability to significantly reduce the transmittal therethrough of oxygen and other gas borne impurities.

BRIEF DESCRIPTION OF THE DRAWINGS

The instant invention may be better understood by reference to the accompanying drawings of which.

DETAILED DESCRIPTION

Figure 1:
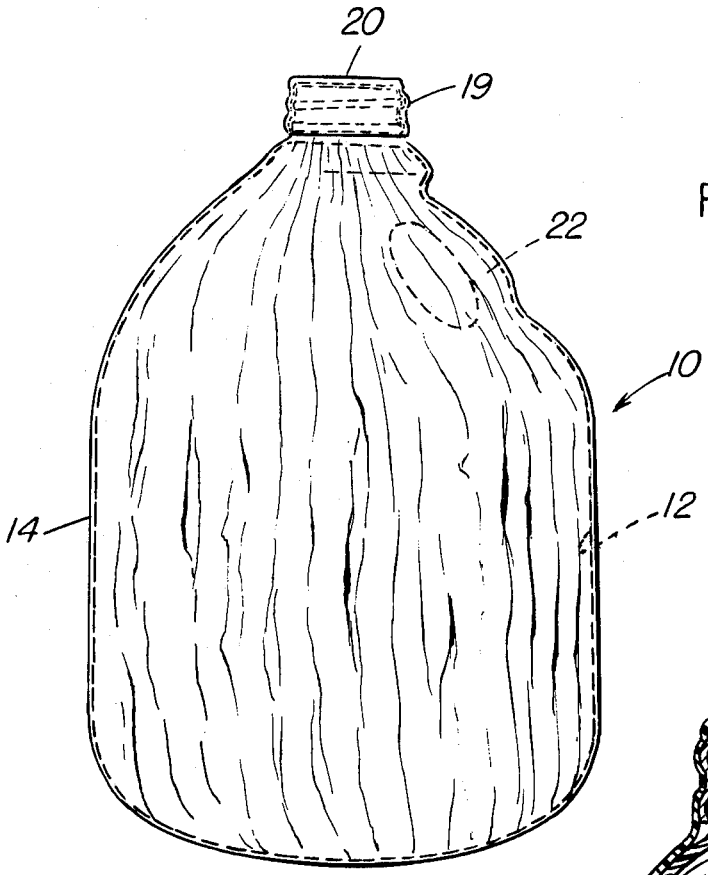
FIG. 1 is a perspective drawing of the container of the instant invention.

Turning now to the drawings in detail, a container 10 in accordance with the instant invention is shown in FIG. 1. The container 10 includes a body 12 defining a volume for the storage of a fluid. The body is constructed of a blow moldable thermoplastic material. The thermoplastic materials suitable for employment as the container body 12 include polyolefins, polycarbonates, polyacetals, polyesters, and polynitriles. Of these blow moldable thermoplastic materials, the polyolefins are particularly preferred for use as the body member 12 of the container 10. Among the preferred polyolefins within the contemplation of this invention are polyethylene and polypropylene. Of these polyolefins, the more preferred material is polyethylene. In a preferred embodiment of this invention the material of construction of the body 12 is polyethylene having a density of at least 0.95 grams per cubic centimeter. More specifically, the density of the polyethylene suitable for the body 12 of the container 10 of this invention is in the range of between about 0.951 and 0.97 grams per cubic centimeter. In a still more preferred embodiment of this invention, the density of the polyethylene is in the range of between about 0.957 and 0.965 grams per cubic centimeter.

It is critical that the body 12 be opaque to light having a wavelength in the range of between about 3500 and 5500 Angstroms. That is, the frame must essentially bar the transmittance therethrough of light waves in this wavelength range. One obvious method for providing such a condition is to so design the thickness of the frame so that light in this wavelength does not penetrate to the liquid. Obviously, this is not a particularly preferred method in that it oftentimes requires an excess wall thickness. A large wall thickness makes for a bulky and heavy bottle which is difficult to handle and ship. In addition, the cost of a heavy wall bottle make such a method oftentimes uneconomic. Although a heavy gauge frame is within the contemplation of this invention, if it essentially bars the transmittance of light having a wavelength within the range of 3500 to 5500 Angstrom units, it is preferred to employ a pigment which serves this purpose without requiring that the body 12 be of undue thickness. Of the additives that may be employed as a pigment to provide opaqueness, the most preferred is titanium dioxide. Titanium dioxide not only makes an otherwise clear thermoplastic opaque, but, in addition, it has the additional advantage of pigmenting the thermoplastic white. In view of the fact that milk represents the most important liquid food application for the container 10 of this invention, a white container is deemed aesthetically the most attractive.

While it has been found that a pigment concentration of at least 0.5 percent by weight, based on the total weight of the frame, that is, the total weight of the thermoplastic and the pigment, is necessary it is preferred that a somewhat greater concentration of pigment be employed. In the case where titanium dioxide is employed as a pigment it is preferred that the concentration of the titanium dioxide be in the range of between about 1 and 4 percent by weight of the total weight of the frame.

The body 12 may be provided with additional features such as a handle 22 illustrated in FIG. 1. Typically, the bottle is formulated by well established blow molded techniques and the container 10 may be provided with still other features depending upon the mold design. Of course, the container of this invention is not limited to the method by which it is formed and other methods other than blow molding techniques that may be used to produce the bottle of container 10 of this invention are within the scope of the invention.

Surrounding the body 12 is an overwrap of a thermoplastic film, designated in the drawings at 14. The thermoplastic film is, in a preferred embodiment, in the range of between about 0.5 and 2.5 mils thick, that is, the film has a thickness in the range of between about 0.0005 and 0.0025 inch. The function of the film is to provide a barrier to prevent the diffusion of oxygen through the container walls. The thermoplastic film also provides a barrier coating against other gaseous species which have an adverse effect on liquid foods. For instance, objectionable odors which may be present in a food retail establishment can be diffused into milk and other liquid foods to affect the taste and odor of the milk. Most thermoplastic films which have significant resistance to oxygen also provide a barrier against the diffusion of other gaseous species. Among the thermoplastic films that provide good barrier properties against gas diffusion, and are thus within the contemplation of this invention, are polyester, nitrile barrier resins, polyvinyl chloride, polyamides, polyvinylidene chloride, polyvinylidene chloride coated polyethylene, polyvinylidene chloride coated polyester, and polyvinylidene chloride coated polyamide films.

For aesthetic purposes another desirable property of the thermoplastic film overwrap 14 is shrink wrap capability. In order for the overwrap film 14 to be effective it must be in close proximity to the outer surface of the thermoplastic body 12. To be in relative intimate contact with the body 12 it is preferred that the film 14 be shrunk about the frame 12 to provide a snug overwrap fit.

Like all containers, the container 10 includes a means for ingress and egress for the fluid contained therein. This means is provided by the opening 18 provided at the top of the container. In a preferred embodiment, the body 12 of the container 10 is provided with a screw thread adjacent the opening 18. The thread 19 is preferably provided to accommodate a covering means 20 which in a preferred embodiment is a cap. The cap is threaded to screw onto the container and is thus reuseable. The cap 20 is preferably designed to bar the transmittal therethrough of deleterious lightwaves.

Figure 3:
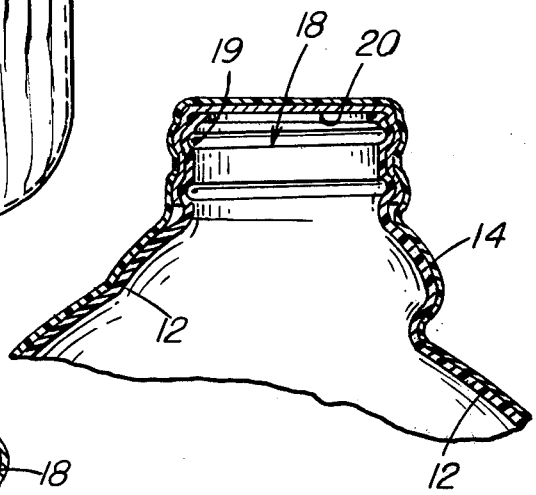
FIG. 3 is a cross-sectional view of the top of the container showing an alternate preferred embodiment.

In a preferred embodiment, the thermoplastic film 14 overwrap provides a unique additional function of providing a second seal, in addition to the cap 20, over the means of ingress and egress, that is, the opening 18. Thus, the container 10 is an improvement over the currently employed containers of the prior art which do not provide any seal other than a cap. This preferred feature of the instant invention is provided for in one of two preferred ways as shown in FIGS. 2 and 3.

Figure 2:
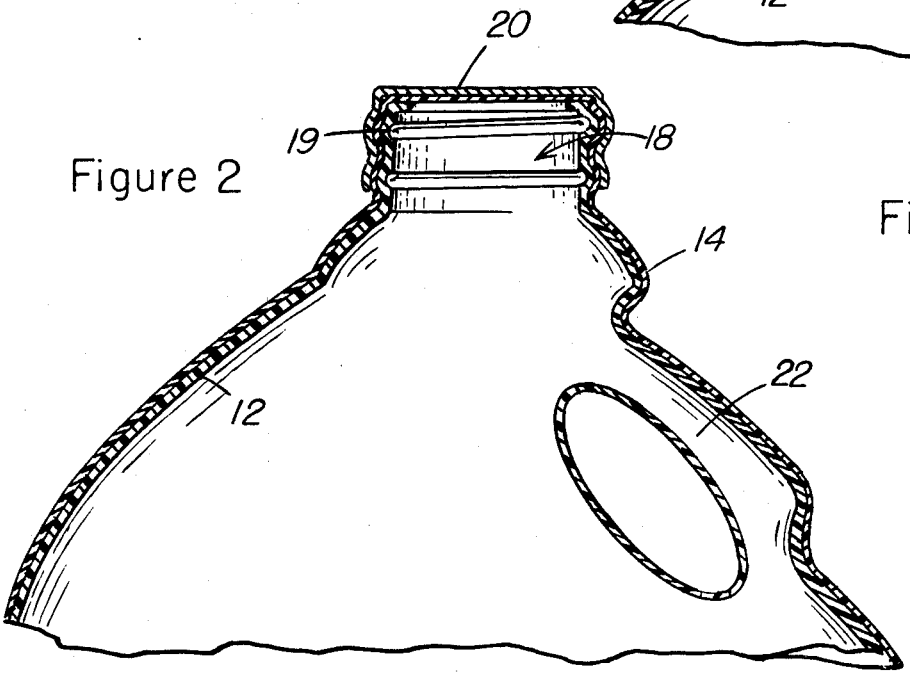
FIG. 2 is a cross-sectional view of the top of the container of the instant invention.

In the first preferred embodiment, illustrated in FIG. 2, the film 14 is disposed over the opening 18 under the cap 20. In the second preferred embodiment, illustrated in FIG. 3, the film overwrap 14 is disposed over the cap 20. Both methods provide the unique advantage of providing a double seal prior to first usage of the contents of the container 10.

The container 10 of the instant invention is prepared by first molding the frame member 12. The molding operation is preferably performed by conventional blow molding techniques. For example, the thermoplastic resin may be injected into an extruder, extruded into a parison and blown into the container shape desired. In a preferred embodiment wherein a thermoplastic resin is provided with a pigment representing at least 0.5 percent by weight of the total weight, the resin may be pre-blended with the dye, such as titanium dioxide, prior to injection into the extruder or, in another alternate preferred embodiment, the resin and the opacifying material are blended together at the extruder. In either case, the formed container includes the agent which makes the bottle opaque to deleterious lightwaves.

In the preferred embodiment wherein the thermoplastic film is used as a primary sealant for the means of ingress and egress, as illustrated in FIG. 2, the next step comprises filling the container frame 12 with the liquid food product.

After the container is filled, the thermoplastic film 14 is wrapped about the frame 12 which contains the liquid food product. The wrapping step is a conventional one wherein the frame 12 is placed is a sleeve of the preferably shrinkable thermoplastic film 14. The open end of the thermoplastic film sleeve is then sealed by conventional sealing techniques, for example, heat sealing in a manual L-sealer. The sealed container 12, which is filled with the liquid food product, is then shrunk to provide a tight overwrap. This may be accomplished by using a conventional shrink tunnel. It is emphasized that the shrinkable thermoplastic films of this invention does not adhere to the container but merely serve as an overwrap.

In the formation of the alternate preferred embodiment of this invention wherein the thermoplastic film acts as a secondary seal, for the means of ingress and egress, the frame member 12 is initially filled with the liquid food product followed by sealing with the covering means or cap 20. Thereafter, the thermoplastic shrinkable film is overwrapped over the frame 12 to form the container 10. This is accomplished by repeating the procedure enumerated above for overwrapping the film 14 over the frame 12. The resultant container is illustrated in FIG. 3 of the drawings.

The sealed container 10, which is filled with a liquid food product, is ready for storage or shipping. In the preferred embodiment wherein the liquid food is asceptically prepared, that is, processed in such a way that substantially all the bacteria within the liquid food are destroyed, the unique container of this invention is capable of maintaining the liquid food in its original condition for an unlimited period of time.

The following examples are given to illustrate the instant invention. Since these examples are given for illustrative purposes only, they are not intended and should not be construed as limiting the invention in any way.

EXAMPLE I

A series of experiments were run to confirm the deleterious effect, known in the prior art, of visible light on liquid food nutrient value and liquid food taste. In these experiments the same liquid food was placed in various containers and subjected to the same environmental conditions. Five different containers were employed in this test. The capacity of each of the containers tested was 1 gallon. The five different containers were as follows: (A) clear glass, (B) amber glass, (C) polyethylene coated paper, (D) clear polyethylene, (E) polyethylene containing 2.3 percent of titanium dioxide.

Two liquid food products were tested in this experiment. The first was pasteurized milk which was fortified to a vitamin A level of 7480 units per quart. The milk was stored in a plurality of each of the five types of containers enumerated above. The vitamin A level in the milk was tested every few days during the 24 day length of the test. The decrease in nutrient value was quantitatively measured as the decrease in the vitamin A level of the milk. In addition, a flavor or taste test was conducted to determine the taste effects of the storage in the different containers under the conditions to be described below.

The containers, filled with the vitamin A fortified milk, were placed in a cold room maintained at a temperature of 40° F. plus or minus 2° F. The cold room was designed to simulate the lighting conditions in a conventional "dairy case." Thus, "cool white" fluorescent lamps were used to supply light. A total of four 40 watt lamps were employed in the test. A light exposure meter was employed to adjust the fluorescent lamps so that the light exposure at the top of the containers was equal to the average of those found in commercial dairy cases.

The vitamin A level, measured in units per quart, was determined by standard analytical test methods. The flavor rating was based on the ratings given by a panel of flavor experts in accordance with procedures well established in the food industry. The flavor or taste test was conducted twice, initially after 8 days storage and again after the completion of the test, that is, after 24 days. The results of these tests are enumerated below in Tables I, II and III. Table I tabulates the results of the nutrient value test, while Tables II and III summarize the results of the flavor of taste tests.

TABLE I

| | | Vitamin A in Milk (units/quart) | | | | | | | | | |
|---|---|---|---|---|---|---|---|---|---|---|---|
| | Initial Vitamin A | Days stored under fluorescent light at 40° F. | | | | | | | | | |
| Container | Level | 3 days | 5 days | 7 days | 10 days | 12 days | 14 days | 17 days | 19 days | 21 days | 24 days |
| A. 1 gal. clear glass | 7480 | 5240 | 4550 | 3780 | 2250 | 1670 | 1490 | — | — | — | — |
| B. 1 gal. amber amber glass | 7480 | 7450 | 7440 | 7390 | 6950 | 6710 | 6710 | 6600 | 6590 | 6510 | 6510 |
| C. 1 gal. polyethylene coated paper | 7480 | 7400 | 7330 | 7200 | 6860 | 6620 | 6590 | 6510 | 6500 | 6500 | 6600 |
| D. 1 gal. clear polyethylene | 7480 | 4280 | 3620 | 2300 | 1580 | 1420 | — | — | — | — | — |
| E. 1 gal. poly- | 7480 | 7290 | 7330 | 7380 | 6900 | 6610 | 6710 | 6610 | 6500 | 6510 | 6280 |

TABLE I-continued

| Container | Initial Vitamin A Level | Vitamin A in Milk (units/quart) Days stored under fluorescent light at 40° F. 3 days | 5 days | 7 days | 10 days | 12 days | 14 days | 17 days | 19 days | 21 days | 24 days |
|---|---|---|---|---|---|---|---|---|---|---|---|
| ethylene containing 2.3% titanium dioxide | | | | | | | | | | | |

TABLE II

| Code | Milk Flavor After 8 Days Score | Milk Trials | Ave. |
|---|---|---|---|
| A. Clear glass | 45.0 | 9 | 5.00 |
| B. Amber glass | 71.5 | 9 | 7.94 |
| C. Polyethylene Coated Paper | 73.5 | 9 | 8.16 |
| D. Clear Polyethylene | 43.5 | 9 | 4.83 |
| E. Polyethylene with 2.3% titanium dioxide | 53.5 | 9 | 5.94 |

TABLE III

| Code | Milk Flavor After 24 Days Score | Milk Trials | Ave. |
|---|---|---|---|
| A. Clear glass | 59.0 | 18 | 3.28 |
| B. Amber glass | 189.0 | 29 | 6.5 |
| C. Polyethylene Coated Paper | 171.5 | 27 | 5.9 |
| D. Clear Polyethylene | 53.5 | 15 | 2.98 |
| E. Polyethylene with 2.3% titanium dioxide | 136.5 | 29 | 4.7 |

The results of the above tests clearly confirm that exposure to fluorescent light waves has a significant adverse affect on the nutrient value and flavor of vitamin A fortified homogenized whole milk which is conventionally pasteurized i.e., exposed to 167° F. for 22 seconds. This is manifested by the nutrient value and flavor results reported for the milk stored in the exposed containers. That is, the nutrient value and flavor of milk stored in the clear glass and clear polyethylene containers were significantly poorer than the results obtained in the other three containers which were all opaque. Indeed, the nutrient loss in the clear glass and polyethylene containers was so great after 12 to 14 days, an 80 percent decrease in vitamin A level, that further testing for nutrient value was discontinued in these cases. It is noted that storage in any of the three opaque containers, the polyethylene coated paper, the amber glass and the polyethylene containing 2.3 percent of titanium dioxide resulted in relatively small losses in nutrient value and were all acceptable in terms of nutrient loss as a function of exposure to light.

The results correlating loss of flavor as a function of storage in a lighted room depending on container material confirms that clear materials, that is, clear glass and clear polyethylene containers yield totally unacceptable results. It is noted that the nutrient value of the milk in the polyethylene container filled with 2.3 percent titanium dioxide is somewhat lower than the values obtained for the glass and paper containers. In this respect it is also noted that the poor result for the milk in the non-pigmented polyethylene container is even worse than the result for the milk tested from the clear glass container. These results are explainable due to the lower original flavor of the milk which was stored in the polyethylene bottles. The original flavor rating of the milk stored in the polyethylene containers was a slight off taste not defined as oxidized.

EXAMPLE II

The test described above for fortified homogenized and pasteurized whole milk was repeated to confirm the above described effect on another very widely consumed liquid food, orange juice. In this test frozen orange juice concentrate was reconstituted by the addition of water as directed on the concentrate label. The reconstituted product was thoroughly mixed to insure a uniform product. The orange juice was tested to determine its initial vitamin C level, which was 65.1 mg/100 grams of product. This orange juice was immediately put into storage at 40° F. under the same conditions as obtained in the testing of the whole milk. Again, the juice was tested for nutrient value, as manifested by its vitamin C level and taste. As in the milk test the same five types of containers were tested. The results of the nutrient test is tabulated in Table IV which appears below.

TABLE IV

| Container | Initial Vitamin C Level | Vitamin C in Orange Juice (mgs/100 gms) Days Stored Under Fluorescent Light at 40° F. 3 days | 5 days | 7 days | 10 days | 12 days | 14 days | 17 days | 19 days | 21 days | 24 days |
|---|---|---|---|---|---|---|---|---|---|---|---|
| A. 1 gal. clear glass | 65.1 | 63.0 | 62.0 | 61.0 | 57.2 | 56.0 | 55.3 | 55.0 | 54.1 | 54.1 | 53.0 |
| B. 1 gal. amber amber glass | 65.1 | 64.0 | 63.0 | 61.8 | 59.0 | 58.3 | 57.5 | 57.1 | 56.5 | 56.0 | 58.3 |
| C. 1 gal. polyethylene coated paper | 65.1 | 63.0 | 61.7 | 60.5 | 55.0 | 53.9 | 52.6 | 51.5 | 49.9 | 49.9 | 52.1 |
| D. 1 gal. clear polyethylene | 65.1 | 63.0 | 62.0 | 61.0 | 57.2 | 56.5 | 56.0 | 55.0 | 54.1 | 54.1 | 56.8 |
| E. 1 gal. polyethylene containing 2.3% titanium dioxide | 65.1 | 64.0 | 63.0 | 61.8 | 58.5 | 58.0 | 57.5 | 57.1 | 56.5 | 56.5 | 58.0 |

The above results indicate that nutrient value of orange juice is not significantly adversely affected by the presence of fluorescent light. However, it is noted that the clear containers, containers A and D, the clear glass and the clear polyethylene containers, are somewhat lower than the opaque containers, the amber glass and the polyethylene container which includes 2.3 percent of the pigment titanium dioxide. To this extent the results confirm the proposition that opaque containers significantly improve storage of liquid foods. A somewhat unique result is noted for the coated paper container. For reasons unknown to the experimenters a paper package yielded lower values than any of the other packages in terms of retention of vitamin C. The results relative to the flavor test again confirm the marked loss of flavor resulting from the storage of liquid foods exposed to fluorescent light. The results of this test for orange juice exposed to fluorescent light after 8 days and 24 days are summarized below in Tables V and VI respectively.

TABLE V

Orange Juice Flavor After 8 Days

| Container | Orange Juice Score | Trials | Ave. |
|---|---|---|---|
| A. Clear glass | 43.0 | 9 | 4.77 |
| B. Amber glass | 73.5 | 9 | 8.15 |
| C. Polyethylene Coated Paper | 69.5 | 9 | 7.72 |
| D. Clear Polyethylene | 45.0 | 9 | 5.00 |
| E. Polyethylene with 2.3% titanium dioxide | 56.0 | 9 | 6.22 |

TABLE VI

Orange Juice Flavor After 24 Days

| Container | Orange Juice Score | Trials | Ave. |
|---|---|---|---|
| A. Clear glass | 128.8 | 29 | 4.45 |
| B. Amber glass | 201.0 | 29 | 6.95 |
| C. Polyethylene Coated Paper | 187.5 | 29 | 6.47 |
| D. Clear Polyethylene | 131.0 | 29 | 4.52 |
| E. Polyethylene with 2.3% titanium dioxide | 155.5 | 29 | 5.35 |

As seen in these tables, degradation in flavor was most pronounced when the orange juice was stored in clear containers. It is noted that flavor loss was within acceptable limits in all cases where the orange juice was stored in opaque containers.

EXAMPLE III

Examples I and II confirm the proposition that opaque containers provide significantly improved resistance against flavor and nutrient loss occasioned by exposure to light waves in the range of 3500 to 5500 Angstrom units. In a second set of experiments the resistance of containers of the type claimed herein, as well as comparison containers, were tested to determine the degree to which they permit transmittance through their walls of light waves in the critical wave length range discussed above as well as determining their resistance to oxygen permeation, a well established cause of flavor and and nutrient loss in liquid foods.

In this set of experiments, the containers were limited to high density polyethylene. In addition to a clear container, a white polyethylene container was tested, that is, a container in which titanium dioxide is incorporated to provide opacity. Furthermore, each of the containers were provided with an overwrap of a polyvinylchloride 1 mil thick thermoplastic film to provide additional test containers.

In the first test the relative light transmittance through these high density polyethylene containers was compared. In this test each of the containers was tested to determine resistance to transmittance of light in the wavelength range known to be deleterious to liquid food products. In the first set of tests two wall size containers are tested. The first, a thin wall container, had a wall thickness of 24 mils (0.024 inch) and a total weight of 83 grams. The heavy wall container was 39 mils thick and weighed 135 grams. Thus, 8 different containers were tested. The results of this test is tabulated below in Table VII.

TABLE VII

Light Transmittance Through HDPE Containers

| Container Sample | % Transmittance of Light 3500 Å | 4000 Å | 4500 Å | 5000 Å | 5500 Å |
|---|---|---|---|---|---|
| Clear (24 mils) | 0.5 | 0.9 | 1.6 | 2.6 | 3.8 |
| Clear (39 mils) | 0.2 | 0.3 | 0.4 | 0.6 | 1.0 |
| White Opaque (24 mils) | 0.0 | 0.0 | 0.05 | 0.05 | 0.05 |
| White Opaque (39 mils) | 0.0 | 0.0 | 0.05 | 0.05 | 0.05 |
| Clear (24 mils)/PVC | 0.3 | 0.5 | 0.9 | 1.5 | 2.4 |
| Clear (39 mils)/PVC | 0.2 | 0.3 | 0.5 | 0.8 | 1.55 |
| White (24 mils)/PVC | 0.0 | 0.0 | 0.075 | 0.075 | 0.1 |
| White (39 mils)/PVC | 0.0 | 0.0 | 0.025 | 0.05 | 0.05 |

The data in Table VII clearly establishes the effects noted in Examples I and II. That is, the greater the opacity of the container the greater the degree of resistance to transmittal of deleterious light waves. Thus, the addition of a pigment, in this case, titanium dioxide, significantly improves container resistance to light transmission.

In the example tabulated above, four samples included a clear polyvinyl chloride overwrap. This barrier film, having a thickness of 1 mil, did not appreciably affect the transmittal of light through the container. This is to be expected in view of the transparency of the film. It should be appreciated, of course, that the purpose of the barrier film is to prevent oxygen permeation.

EXAMPLE IV

Another set of experiments were conducted to determine to resistance of the containers of Example III to oxygen permeation. To this end, seven container samples were tested. The first, a control, was a high density polyethylene thin wall container. In addition, six other high density polyethylene containers were tested. The second container tested was a modification of the first container, a thin walled high density polyethylene container provided with a pigment, titanium dioxide to make it opaque. The third high density polyethylene sample was a clear thick walled container. The fourth container was similar to the third, a thick walled container except that it was provided with titanium dioxide to make it a white container. The fifth was a light weight thin walled container including titanium dioxide and provided with a 1 mil thick polyvinyl chloride film overwrap. The sixth container was a thin walled clear container with a 0.75 mil thick polyethylene terephthalate film overwrap. The last container was a thin walled container made opaque by the addition of titanium dioxide and overwrapped with an 0.75 mil thick polyethylene terephthalate film. The seven samples were tested at a temperature of 50° C. employing a polymer permeation analyzer. This analyzer determines the rate of gas transmission in terms of volume of gas transmitted per unit time. The actual units measured were cubic centimeters of oxygen per 24 hours per 100 square inches of surface measured at 50° C. and 1 atmosphere. The results of this test are tabulated below in Table VIII.

TABLE VIII

Oxygen Permeation Through HDPE Containers for Asceptic Packaging

| Container | Gas Transmission Rate cc $O_2$/24 hrs. 100 in.$^2$ |
|---|---|
| Control - Clear (24 Mil Wall Thickness) | 21 |
| White Opaque (24 mils) | 17 |
| Clear (39 mils) | 3.9 |
| White Opaque (39 mils) | 3 |
| White Opaque/PVC (24 mils/1 mil) | 8 |
| Clear/PET (24 mils/.75 mil) | 6.3 |
| White Opaque/PET (24 mils/.75 mil) | 1.4 |

The data tabulated in Table VIII indicates the significant reductions in gas transmission rate of oxygen, which is desirable, achieved by the use of either a thicker walled container or a thin walled container provided with a barrier film. It is unexplained, but the best results are synergistically obtained by the case where a thin walled container provided with titanium dioxide and overwrapped with a polyester film, polyethylene terephthalate, outperforms all the other containers including thick walled container by at least a factor of 2. The significantly improved oxygen permeation data tabulated above is even more outstanding when one considers that at lower temperature the oxygen permeation rate is significantly decreased. For example, although a thin walled white container permits 17 cubic centimeters of oxygen to permeate its walls at 50° C. in 24 hours over a surface of 100 square inches, at 4° C., the present temperature employed in storing milk, this value is reduced to 5 cubic centimeters of oxygen. Projecting the utilization of these bottles in room temperature storage of super pasteurized milk, the rate is increased only to 8.5 cubic centimeters of oxygen.

The description of the preferred embodiments and examples given above are meant to be illustrative of the scope and spirit of the instant invention. These preferred embodiments and examples will make apparent other embodiments and examples within the scope and spirit of the invention described herein. These other embodiments and examples, within the scope and spirit of this invention, are within the contemplation of this invention. Therefore, the invention should be limited only by the appended claims.

What is claimed is:

1. A package comprising:

a blow molded thermoplastic container defining a volume filled with a liquid food sensitive to light and oxygen, said container providing means for ingress and egress of said liquid, said thermoplastic container including titanium dioxide, present in a concentration of at least 0.5% by weight, based on the total weight of the container which essentially bars the transmittance therethrough of light having a wavelength in the range of between about 3500 and 5500 Angstrom units; and an overwrap of polyethylene terephthalate film having a thickness of about 0.5 to 2.5 mils and disposed over said thermoplastic container, completely enclosing it.

2. A package in accordance with claim 1 wherein said titanium dioxide comprises between about 1 and 3% by weight, based on the total weight of said thermoplastic body.

3. A package in accordance with claim 1 wherein said polyethylene terephthalate film has a thickness in the range of between about 0.5 and 1.0 mil.

4. A package in accordance with claim 1 wherein said blow molded thermoplastic body is selected from the group consisting of polyolefins, polycarbonates, polyacetals and polyesters.

5. A package in accordance with claim 4 wherein said blow molded thermoplastic body is polyethylene having a density of at least 0.95 gram per cubic centimeter.

6. A package in accordance with claim 5 wherein said polyethylene has a density in the range of between about 0.957 and 0.965 gram per cubic centimeter.

7. A package in accordance with claim 1 wherein said polyethylene terephthalate film overwraps said entire thermoplastic body including said means of ingress and egress providing a complete seal of the contents of said container.

8. A package in accordance with claim 7 including a cap to seal said means of ingress and egress of said thermoplastic body, said cap disposed over said film overwrap.

9. A package in accordance with claim 7 including a cap to seal said means of ingress and egress of said thermoplastic body, said cap disposed under said film overwrap.

10. A package in accordance with claim 1 wherein said liquid food contained in said container is an asceptic liquid food.

11. A package in accordance with claim 10 wherein said asceptic liquid food is milk.

* * * * *